US007124967B2

(12) United States Patent
Chung

(10) Patent No.: US 7,124,967 B2
(45) Date of Patent: Oct. 24, 2006

(54) FAN JET NOZZLE FOR USE WITH ULTRA HIGH PRESSURE LIQUID PHASE CLEANING MEDIA FOR USE IN DEFLASHING APPARATUS

(75) Inventor: Jae Song Chung, Inchun-Shi (KR)

(73) Assignee: Jettech Ltd., Kyunggi-Do (KR)

( * ) Notice: Subject to any disclaimer, the term of this patent is extended or adjusted under 35 U.S.C. 154(b) by 88 days.

(21) Appl. No.: 10/838,741

(22) Filed: May 4, 2004

(65) Prior Publication Data

US 2005/0133641 A1 Jun. 23, 2005

(30) Foreign Application Priority Data

Dec. 22, 2003 (KR) ..... 20-2003-0039766

(51) Int. Cl.
*A62C 31/02* (2006.01)
*B05B 1/00* (2006.01)

(52) U.S. Cl. ..... 239/601; 239/600; 239/596; 239/599; 239/589; 239/DIG. 19

(58) Field of Classification Search ..... 239/305, 239/596, 600, 591, 599, 601, 589, DIG. 19; 451/102
See application file for complete search history.

(56) References Cited

U.S. PATENT DOCUMENTS

| | | | | |
|---|---|---|---|---|
| 2,774,631 | A * | 12/1956 | Wahlin | 239/590.3 |
| 3,510,065 | A * | 5/1970 | Gigantino et al. | 239/590 |
| 4,185,706 | A * | 1/1980 | Baker et al. | 175/340 |
| 4,365,758 | A | 12/1982 | Schaming | |
| 5,052,624 | A | 10/1991 | Boers et al. | |
| 5,417,607 | A | 5/1995 | Raghavan | |
| 6,398,128 | B1 * | 6/2002 | Hamilton et al. | 239/71 |

* cited by examiner

*Primary Examiner*—Dinh Q. Nguyen
(74) *Attorney, Agent, or Firm*—Jordan and Hamburg LLP

(57) ABSTRACT

A fan jet nozzle for use with an ultra high pressure liquid-phase cleaning media for use in a deflashing apparatus includes a nozzle tip, which is made of a super hard material such as diamond, and is secured inside a nozzle holder through sintering. Upper and lower nozzle bores above and beneath the nozzle tip are processed to converge and communicate with each other inside the nozzle tip, resulting in a center nozzle hole having an elliptical shape. One of the upper and lower nozzle bores is processed into a circular cone shape, and the other one of the upper and lower nozzle bores is processed to have an arched longitudinal sectional shape and a cross sectional shape wherein its width increases toward a center thereof and decreases toward both sides thereof.

7 Claims, 5 Drawing Sheets

FAN JET NOZZLE FOR USE WITH ULTRA HIGH PRESSURE LIQUID PHASE CLEANING MEDIA FOR USE IN DEFLASHING APPARATUS

BACKGROUND OF THE INVENTION

1. Field of the Invention

The present invention relates to a fan jet nozzle for use with an ultra high pressure liquid-phase cleaning media, which is used as an essential component of a deflashing apparatus for removing flashings during the manufacture of semiconductors, and the like.

2. Description of the Related Art

Examples of fan type nozzles, which have been conventionally used, are disclosed in U.S. Pat. No. 4,365,758, U.S. Pat. No. 5,417,607, and U.S. Pat. No. 5,052,624.

Among the above enumerated patents, in case of said U.S. Pat. No. 4,365,758 and U.S. Pat. No. 5,417,607, their nozzles are composed entirely of a super hard alloy, and are formed with an arched cross groove or wedge-shaped notch for forming a nozzle bore. The super hard alloy and the above mentioned particular shape of the nozzle bore, however, cause a disadvantage in that only a relatively thin amount of material remains around the nozzle bore after processing. As a result, if a discharge pressure increases, the disclosed nozzles tend to be easily worn and damaged at their nozzle bores, thereby suffering from a shortening in lifespan thereof, and making it difficult for the nozzles to endure an ultra high discharge pressure required to remove flashings during the manufacture of semiconductors.

In case of said another patent U.S. Pat. No. 5,052,624, the disclosed nozzle is fabricated by individually processing a nozzle tip and a nozzle holder for the formation of a nozzle bore, and then fixedly attaching them to each other with an adhesive. Such a fabrication manner, however, is unsuitable for mass production due to difficulty in control of tolerances of interactive respective components during manufacturing. Further, since a joint region between the nozzle tip and nozzle holder is vulnerable to external shock, and the nozzle tip is wholly exposed to the outside, there is a risk of damage to the nozzle by carelessness in handling. Furthermore, as a result of processing the nozzle tip to have an elongated transverse slot penetrating therethrough, a relatively thin amount of material remains around the nozzle bore after processing, resulting in a structural vulnerability in the nozzle tip itself.

SUMMARY OF THE INVENTION

Therefore, the present invention has been studied and developed in view of the above problems, and has several objects as follows.

It is a primary object of the present invention to provide a fan jet nozzle for use with an ultra high pressure liquid-phase cleaning media for use in a deflashing apparatus, which can maximize durability and wear-resistance and consequently extend lifespan thereof. This objective is accomplished by virtue of the facts that a nozzle tip of the nozzle is composed of a super hard material such as diamond having a higher hardness and durability than conventionally used super hard alloys and is fixedly embedded inside a nozzle holder through sintering, and that regions above and beneath the nozzle tip are processed to converge and communicate with each other inside the nozzle tip so as to achieve an elliptical nozzle bore, thereby allowing the nozzle bore, a region which may be extremely worn or damaged by an ultra high pressure liquid-phase cleaning media in use, to be formed inside the nozzle tip.

It is another object of the present invention to provide a fan jet nozzle for use with an ultra high pressure liquid-phase cleaning media for use in a deflashing apparatus, which is suitable for mass production and can achieve ease of quality management including control of tolerances. This objective is accomplished by fixedly embedding a nozzle tip inside a nozzle holder through sintering so as to prevent external shock from being directly transmitted to the nozzle tip, and by allowing the overall appearance of the nozzle and the installed position of the nozzle tip inside the nozzle holder to be constantly maintained by virtue of an integral structure of the nozzle tip and nozzle holder obtained from the sintering as well as enabling the processing of a nozzle bore to be uniformly performed from upper and lower sides of the nozzle tip.

It is yet another object of the present invention to provide a fan jet nozzle for use with an ultra high pressure liquid-phase cleaning media for use in a deflashing apparatus, which can maximize lifespan thereof by minimizing damage to a nozzle tip during the processing of a nozzle bore. This objective is accomplished by allowing the processing of the nozzle bore to be vertically performed at regions above and beneath the nozzle tip within a minimum range, instead of being performed to transversely penetrate through the nozzle, so that the overall outer periphery region of the nozzle remains.

In accordance with the present invention, the above and other objects can be accomplished by the provision of a fan jet nozzle for use with an ultra high pressure liquid-phase cleaning media for use in a deflashing apparatus comprising: a nozzle holder internally defining a recess; a nozzle tip made of a super hard material such as diamond, the nozzle tip being secured inside the recess of the nozzle holder through sintering; and a center nozzle hole having an elliptical shape, the center nozzle hole being obtained as upper and lower nozzle bores above and beneath the nozzle tip are processed to converge and communicate with each other inside the nozzle tip, wherein both the upper and lower nozzle bores have an arched longitudinal sectional shape and a cross section shape wherein its width increases toward a center thereof and decreases toward both sides thereof, thereby achieving the elliptical shape of the center nozzle hole.

Preferably, one of the upper and lower nozzle bores may be processed into a circular cone shape, and the other one of the upper and lower nozzle bores may be processed to have an arched longitudinal sectional shape and a cross sectional shape in that its width increases toward a center thereof and decreases toward both sides thereof, thereby achieving the elliptical shape of the center nozzle hole.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
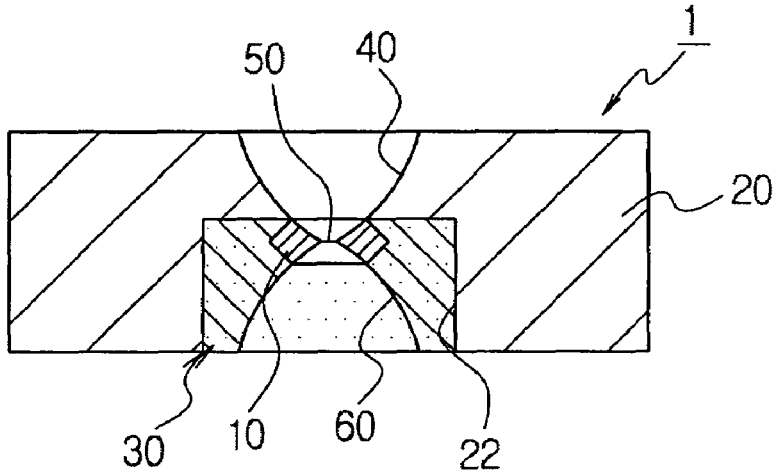
FIG. 1 is a longitudinal sectional view illustrating an important portion of a nozzle in accordance with a preferred embodiment of the present invention.
Figure 2:
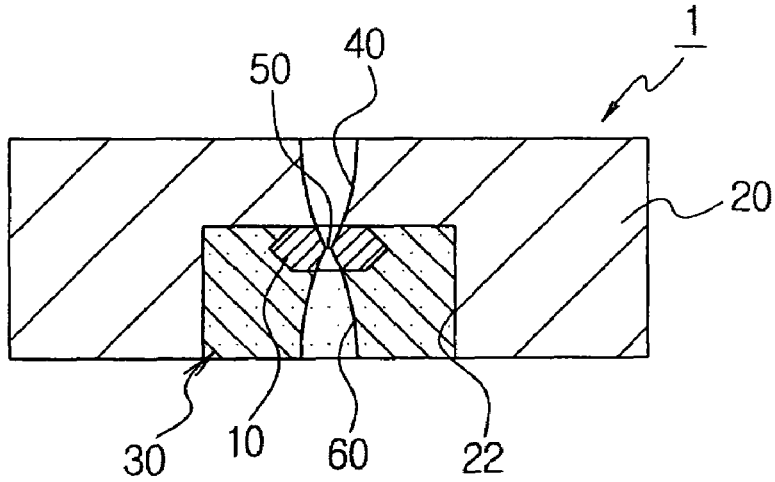
FIG. 2 is a longitudinal sectional view of the nozzle of FIG. 1 viewed from a different direction.
Figure 3:
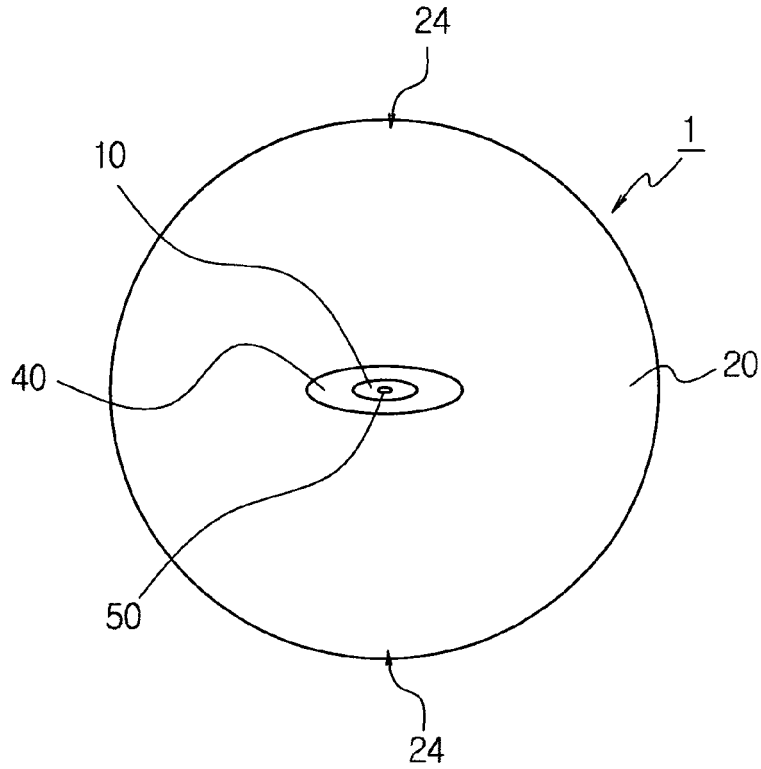
FIG. 3 is a top view of the nozzle of FIG. 1.
Figure 4:
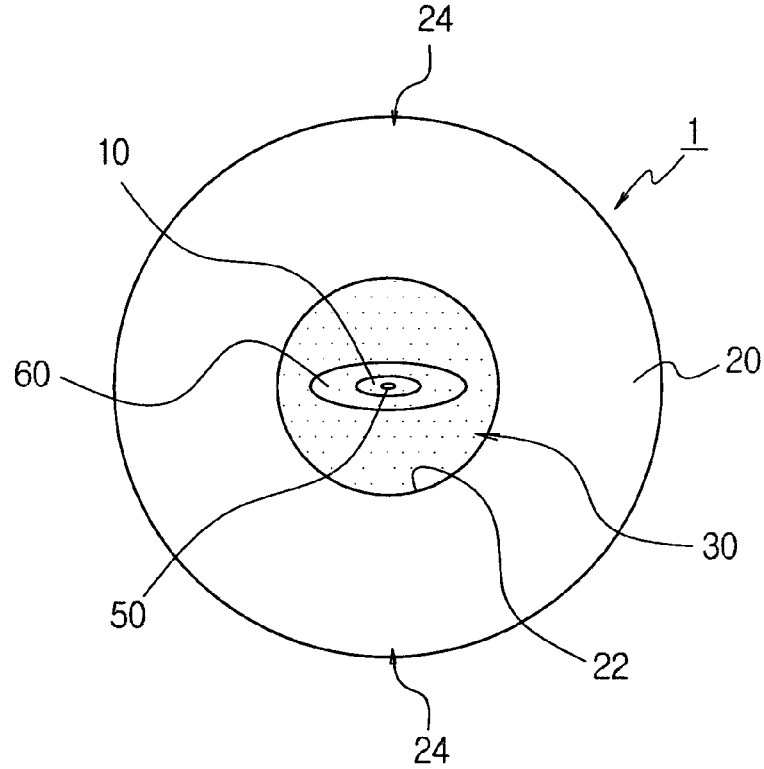
FIG. 4 is a bottom view of the nozzle of FIG. 1.
Figure 5:
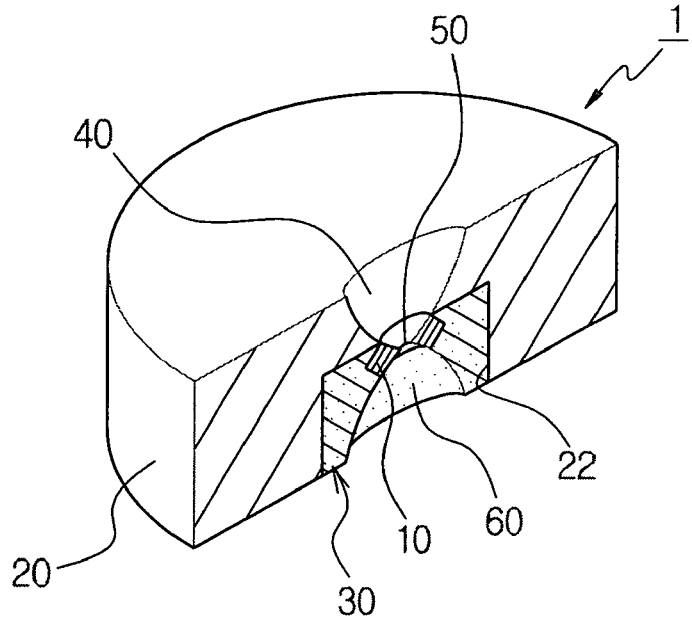
FIG. 5 is a perspective view illustrating a state wherein half of the nozzle is cut away in order to concretely explain the interior structure of the nozzle shown in FIGS. 1 to 4.

Reference will now be made in greater detail to preferred embodiments of the invention, examples of which are illustrated in the accompanying drawings. Wherever possible, the same reference numerals will be used throughout the drawings and the description to refer to the same or like parts.

Referring to FIGS. 1 to 5 illustrating a nozzle in accordance with a preferred embodiment of the present invention, the nozzle, designated as reference numeral 1, is configured by preparing a nozzle tip 10, which is made of a super hard material such as diamond, and securing it inside a recess 22 defined in a nozzle holder 20 through sintering. Certain regions above and beneath the nozzle tip 10 are processed to form upper and lower nozzle bores 40 and 60, and these upper and lower nozzle bores 40 and 60 converge and communicate with each other inside the nozzle tip 10 so as to form a center nozzle hole 50. The center nozzle hole 50 has an elliptical shape. Both the upper and lower nozzle bores 40 and 60 have an arched longitudinal sectional shape and a cross sectional shape wherein its width increases toward a center thereof and decreases toward both sides thereof, resulting in the elliptical shape of the center nozzle hole 50.

Around an outer periphery of the nozzle holder 20 are preferably provided reference position indicators 24. The reference position indicators 24 serve as positioning standards used to continuously keep the nozzle holder 20 at a predetermined position during the processing of the upper and lower nozzle bores 40 and 60, or as installation standards required for installing the nozzle holder 20 inside a nozzle assembly 2, which will be explained hereinafter. The shape of such reference position indicators 24 may be appropriately selected from among simple marks, grooves, or other various shapes as occasion demands.

In the present embodiment, the nozzle tip 10 is made of a super hard material such as industrial diamond, and the nozzle holder 20 is internally defined at a top or bottom side thereof with the recess 22 so that the nozzle tip 10 is centrally mounted inside the recess 22. In such a mounted state, the recess 22 is charged with a sintering agent, which is obtained by mixing a carbide powder such as tungsten and titanium with a binder powder such as cobalt and nickel. Then, a sintering process is performed at a high temperature of approximately 1200 degree. C. and a high pressure of approximately 300 kilograms per square centimeter. In this way, a sintered layer 30 is produced between the nozzle holder 20 and the nozzle tip 10, and is adapted to achieve interactive, firm coupling between the nozzle holder 20 and the nozzle tip 10.

The upper and lower nozzle bores 40 and 60 are processed, for example, by an ultrasonic processing method using a nickel oscillator. In the above processing method, a processing frequency is selected to approximately 25 kHz and a processing amplitude is selected to approximately 3.0 micrometers, and used particles are diamond powder. From the upper and lower sides of the nozzle, the nozzle holder 20 and the nozzle tip 10, and then the sintered layer 30 and the nozzle tip 10 are processed in succession, thereby allowing the upper and lower nozzle bores 40 and 60 to be processed so that the center nozzle hole 50 having the elliptical shape is formed at a region where the upper and lower nozzle bores 40 and 60 converge and communicate with each other.

Figure 6:
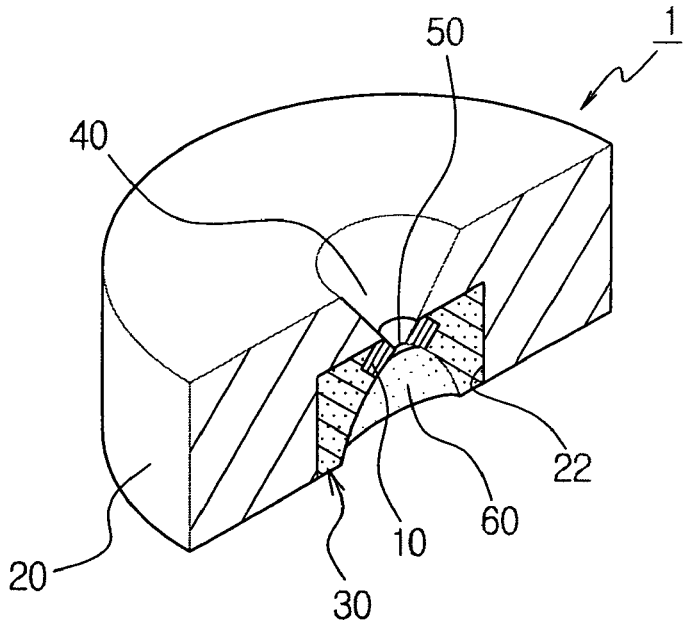
FIG. 6 is a half broken away perspective view illustrating another embodiment of the nozzle in accordance with the present invention, being shown corresponding to FIG. 5.
Figure 7:
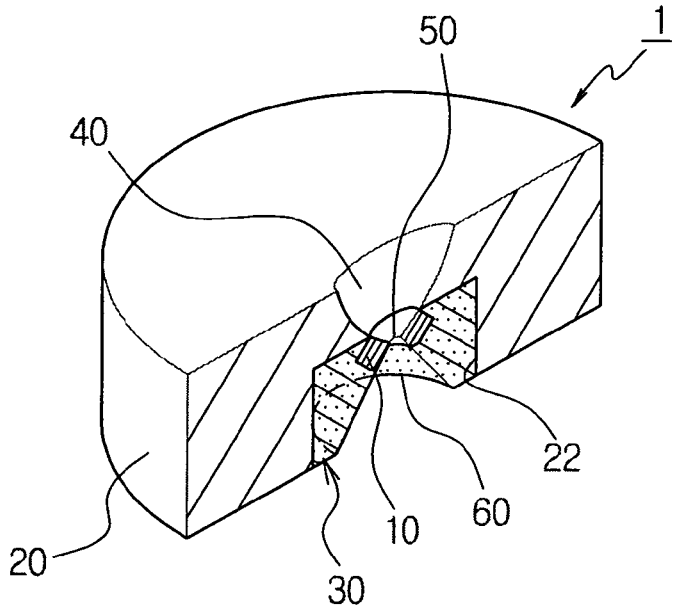
FIG. 7 is a half broken away perspective view illustrating a further embodiment of the nozzle in accordance with the present invention, being shown corresponding to FIG. 5.

Referring to FIGS. 6 and 7 illustrating different two preferred embodiments of the nozzle 1 in accordance with the present invention, respectively, one of the upper and lower nozzle bores 40 and 60 are processed into a circular cone shape, and the other one of the upper and lower nozzle bores 40 and 60 is processed to have an arched longitudinal sectional shape and a cross sectional shape wherein its width increases toward a center thereof and decreases toward both sides thereof, resulting in the elliptical shape of the center nozzle hole 50.

Considering these embodiments in detail, first, in the embodiment shown in FIG. 6, one of the upper and lower nozzle bores 40 and 60, in particular, the upper nozzle bore 40 is processed into a circular cone shape, and the other one of the upper and lower nozzle bores 40 and 60, namely, the lower nozzle bore 60 is processed to have an arched longitudinal sectional shape and a cross sectional shape wherein its width increases toward a center thereof and decreases toward both sides thereof, thereby achieving the elliptical center nozzle hole 50.

In the embodiment shown in FIG. 7, one of the upper and lower nozzle bores 40 and 60, in particular, the lower nozzle bore 60 is processed into a circular cone shape, and the other one of the upper and lower nozzle bores 40 and 60, namely, the upper nozzle bore 40 is processed to have an arched longitudinal sectional shape and a cross sectional shape wherein its width increases toward a center thereof and decreases toward both sides thereof, thereby achieving the elliptical center nozzle hole 50.

Analyzing a technical feature as seen from FIGS. 6 and 7 in detail, as a result of processing one of the upper and lower nozzle bores 40 and 60 into a circular cone shape, that nozzle bore is adapted to have a circular cross section without exception. Then, as the remaining opposite one is processed as stated above until they converge and communicate with each other, the horizontal region where the center nozzle hole 50 is located is formed to have an elliptical shape. With such a technical feature, even if the nozzle holder 20 is horizontally displaced within a certain angular direction, the processing of the remaining opposite nozzle bore is equally performed always regardless of the displacement direction of the nozzle holder 20, thereby achieving the elliptical shape of the center nozzle hole 50. This results in an advantage in that the formation of the center nozzle hole 50 using the upper and lower nozzle bores 40 and 60 can be more conveniently and constantly achieved, resulting in ease in control of tolerances.

Figure 8:
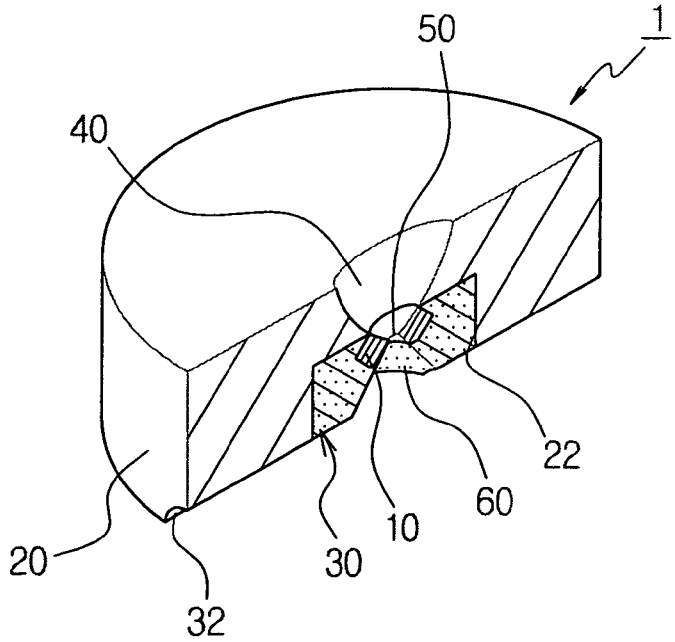
FIG. 8 is a half broken away perspective view illustrating yet another embodiment of the nozzle in accordance with the present invention, being shown corresponding to FIG. 7.
Figure 9:
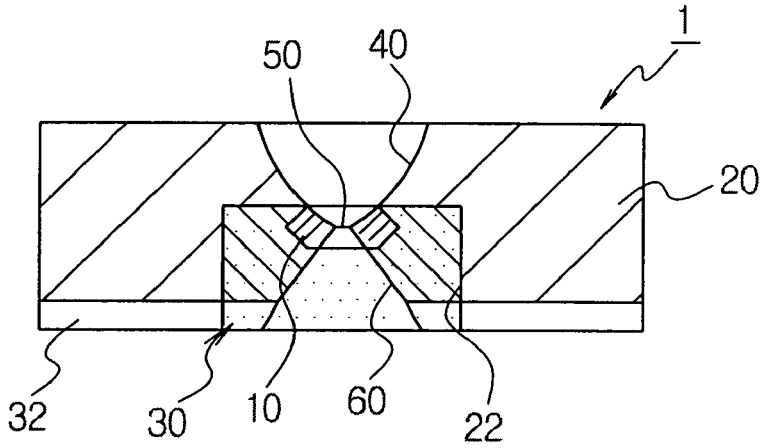
FIG. 9 is a sectional view of the nozzle of FIG. 8.

Referring to FIGS. 8 and 9 illustrating yet another embodiment of the nozzle 1 in accordance with the present invention, one of the upper and lower nozzle bores 40 and 60, namely, the lower nozzle bore 60 is processed into a circular cone shape in the same manner as shown in FIG. 7, and the other one of the upper and lower nozzle bores 40 and 60, namely, the upper nozzle bore 40 is processed to have an arched longitudinal sectional shape and a cross sectional shape wherein its width increases toward a center thereof and decreases toward both sides thereof, thereby achieving the elliptical shape of the center nozzle hole 50. In addition to the basic configuration, the present embodiment specifically shows that a cross slot 32 may be formed throughout one side of the bottom of the nozzle holder 20 if necessary, resulting in a similar configuration to a conventional one.

Although the present invention does not illustrate it specifically herein, in order to achieve various other modifications in addition to the above described various basic configurations shown in FIGS. 1 to 7, various components, for example, the above described cross slot 32, may be additionally formed even if they have no relation with the essence of the present invention, and it can be said that these all modifications are included within the technical scope of the present invention.

Figure 10:
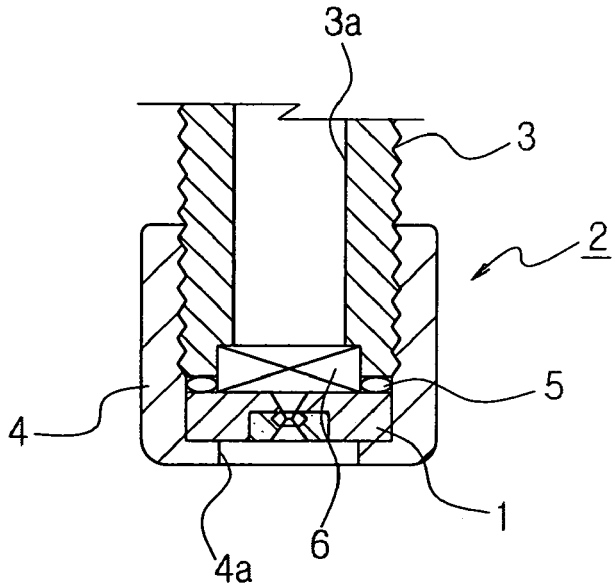
FIG. 10 is a sectional view illustrating only an important portion of the nozzle in accordance with the present invention, wherein it is mounted in a deflashing apparatus.

FIG. 10 illustrates a state wherein the nozzle of the present invention configured as stated above is mounted in a deflashing apparatus in use. For this, as shown in FIG. 10, first, the nozzle 1 is installed to the bottom of a nozzle shaft 3 constituting a nozzle assembly 2. Inside the nozzle shaft 3 is defined a fluid channel 3*a*. Then, the nozzle 1, a seal 5, and a filter 6 are successively disposed inside a nozzle cap 4 formed with a center bore 4*a*, and the nozzle shaft 3 and the nozzle cap 4 are screw fastened to each other for their proper utilization.

In such an assembled state, if an ultra high pressure liquid-phase cleaning media (not shown) is supplied through the fluid channel 3*a*, it is purified by passing through the filter 6, and then the purified cleaning media is discharged to the outside by way of the upper nozzle bore 40, the center nozzle hole 50, the lower nozzle bore 60, and the center bore 4*a* of the nozzle cap 4 in order.

Since the center nozzle hole 50 has an elliptical shape, the cleaning media is discharged into a typical fan type stream wherein the cleaning media spreads widely, resulting in enhancement in cleaning effects.

In this case, by virtue of the fact that the center nozzle hole 50, the region subjected to the highest pressure, is formed inside the nozzle tip 10 made of a super hard material such as diamond, even if an ultra high pressure liquid-phase cleaning media is supplied thereto, the nozzle 1 of the present invention can sufficiently bear the highest pressure and considerably improve an acceptable discharge pressure and durability, thereby optimizing utilization thereof for a deflashing process.

As apparent from the above description, the present invention provides a fan jet nozzle for an ultra high pressure liquid-phase cleaning media in a deflashing apparatus. According to the present invention, the fan jet nozzle is configured in such a fashion that a nozzle tip is made of a super hard material such as diamond having a higher hardness and durability than conventionally used super hard alloys and is fixedly embedded inside a nozzle holder through a sintered layer, and that regions above and beneath the nozzle tip are processed into upper and lower nozzle bores so that they converge and communicate with each other inside the nozzle tip so as to achieve an elliptical center nozzle hole, thereby allowing the center nozzle hole, the region which may be extremely worn or damaged by an ultra high pressure liquid-phase cleaning media in use, to be formed inside the nozzle tip. With such a configuration, it is possible to maximize durability and wear-resistance and consequently extend lifespan of the nozzle.

Further, according to the present invention, since the nozzle tip is fixedly embedded inside the nozzle holder through sintering, the nozzle tip can be completely protected from external shock. By virtue of the fact that such sintering, moreover, results in an integral structure of the nozzle tip and nozzle holder, the overall appearance of the nozzle and the installed position of the nozzle tip inside the nozzle holder can be constantly maintained, and the upper and lower bores can be uniformly processed. As a result, the nozzle of the present invention is suitable for mass production and can achieve ease of quality management including control of tolerances.

Furthermore, according to the present invention, the upper and lower nozzle bores are vertically processed above and beneath the nozzle tip within a minimum range, instead of being processed to transversely penetrate through the nozzle, thereby allowing the overall outer periphery of the nozzle to remain. As a result, it is possible to minimize damage to the nozzle tip after processing the center nozzle hole, resulting in maximization in lifespan thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fan jet nozzle comprising:

a nozzle holder including first and second axially opposing recesses connected at a first common aperture;

a nozzle tip including first and second axially opposing recesses connected at a second common aperture;

said nozzle tip being disposed against an internal surface of said second recess of said nozzle holder so that said first and second apertures are substantially axially aligned;

sintering material secured in said second recess of said nozzle holder and surrounding said first nozzle tip, said sintering material comprising a recess;

said nozzle holder, said nozzle tip and sintering materials each comprising differing materials;

a first nozzle bore defined by connected internal surfaces of said first recesses of both said nozzle tip and said nozzle holder;

a second nozzle bore defined by connected internal surfaces of said second recess of said nozzle tip and said recess of said sintering material; and one of said first and second nozzle bores including an arched longitudinal sectional shape and a cross sectional shape so that a width of said one of said first and second bores increases toward a center thereof and decreases toward both sides thereof, thereby providing said second common aperture with an elliptical shape.

2. The nozzle as set forth in claim 1, further comprising reference position indicators provided around an outer periphery of the nozzle holder.

3. The nozzle as set forth in claim 1, wherein the other of the first and second nozzle bores comprises a circular cone shape.

4. The nozzle as set forth in claim 3, wherein one of the upper and lower nozzle bores, namely, the upper nozzle bore, is processed into a circular cone shape, and the other one of the upper and lower nozzle bores, namely, the lower nozzle bore, is processed to have an arched longitudinal sectional shape and a cross sectional shape in that its width increases toward a center thereof and decreases toward both sides thereof, thereby achieving the elliptical shape of the center nozzle hole.

5. The nozzle as set forth in claim 3, wherein one of the upper and lower nozzle bores, namely, the lower nozzle bore, is processed into a circular cone shape, and the other one of the upper and lower nozzle bores, namely, the upper nozzle bore, is processed to have an arched longitudinal sectional shape and a cross sectional shape in that its width thereof increases toward a center thereof and decreases toward both sides thereof, thereby achieving the elliptical shape of the center nozzle hole.

6. The nozzle of claim 1 wherein said nozzle tip is harder than the nozzle holder and the sintering material.

7. The nozzle of claim 6 wherein the nozzle tip material is diamond.

* * * * *